United States Patent [19]

Smillie, III

[11] Patent Number: 4,824,427

[45] Date of Patent: Apr. 25, 1989

[54] METHOD AND APPARATUS FOR DISPENSING A TAPE PRODUCT

[76] Inventor: Charles M. Smillie, III, 4812 Park Hill Ct., West Bloomfield, Mich. 48033

[21] Appl. No.: 172,641

[22] Filed: Mar. 24, 1988

[51] Int. Cl.[4] ..... B26F 3/02

[52] U.S. Cl. ..... 493/353; 225/25; 493/466; 493/419

[58] Field of Search ..... 493/352, 353; 225/25, 225/79

[56] References Cited

U.S. PATENT DOCUMENTS

| | | | |
|---|---|---|---|
| 2,540,697 | 2/1951 | Staples . | |
| 2,576,404 | 11/1951 | Krueger . | |
| 2,873,967 | 2/1959 | Larson | 493/353 |
| 2,889,146 | 6/1959 | Thompson | 493/353 |
| 3,625,100 | 12/1971 | Barnard . | |
| 3,810,567 | 5/1974 | Malcolm | 493/353 |
| 3,971,280 | 7/1976 | Inka . | |
| 4,384,664 | 5/1983 | Roos . | |
| 4,437,854 | 3/1984 | Knoop | 493/353 |
| 4,540,393 | 9/1985 | Knoop | 493/353 |
| 4,634,415 | 1/1987 | Knoop | 493/353 |

*Primary Examiner*—Frederick R. Schmidt

*Assistant Examiner*—Jack Lavinder

*Attorney, Agent, or Firm*—Dykema Gossett

[57] ABSTRACT

An apparatus dispenses an elongate tape product, with a leading end portion tab. The tape product is drawn along a feeding path to a dispensing end at which a cutting edge is disposed. A stationary touch element is positioned just upstream of the cutting edge, and a movable touch element is disposed in the feeding path upstream of the stationary touch element. The movable touch element translate along the feeding path toward the stationary touch element and into juxtaposition therewith and away from the stationary touch element to a position remote therefrom. When the movable touch element is remote from the stationary touch element and the tape product is drawn to have its leading end portion in sticky or tacking contact with the stationary touch element and a trailing portion in such contact with the movable touch element, the movable touch element may be translated into juxtaposition with the stationary touch element to bring portions of the tape product into contact with one another, thereby forming a tab. The tape may thereafter be drawn by the tab to a desired length and cut off and applied to a surface wherefrom it may be lifted off by grasping the tab and peeling the tape produce back.

14 Claims, 2 Drawing Sheets

FIG. 10
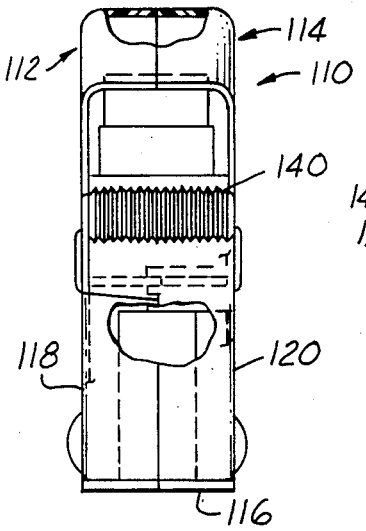
FIG. 9
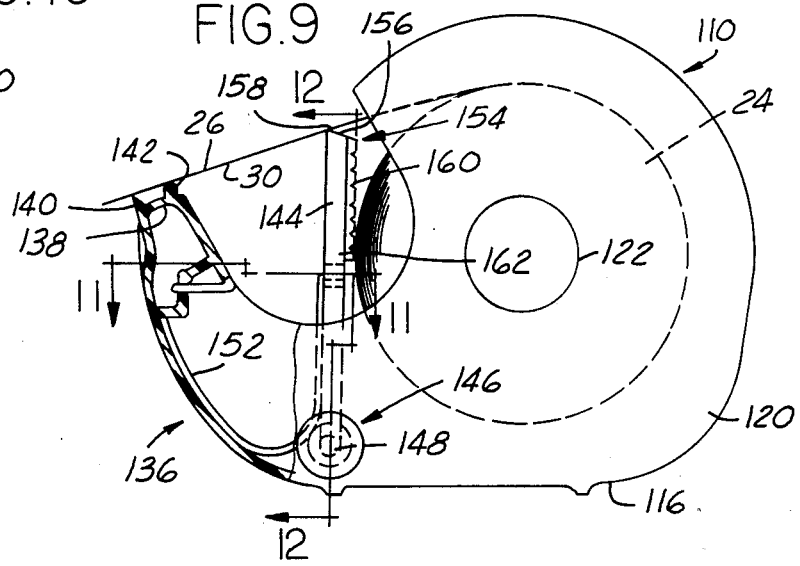
FIG. 11
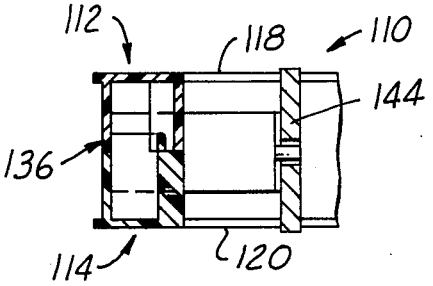
FIG. 12
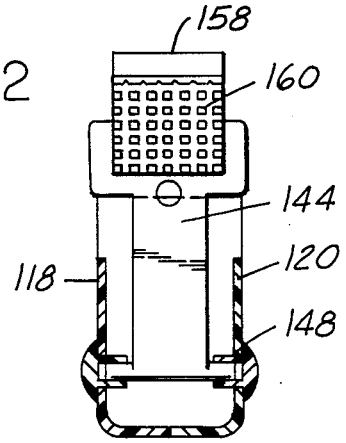
FIG. 14
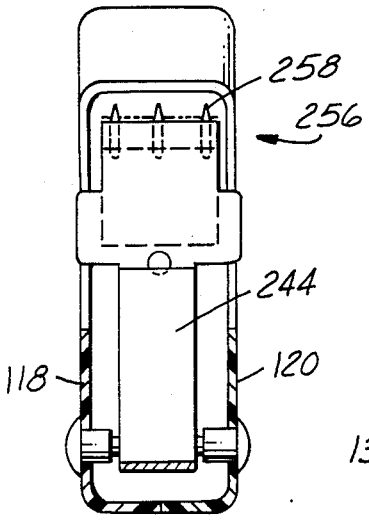
FIG. 13
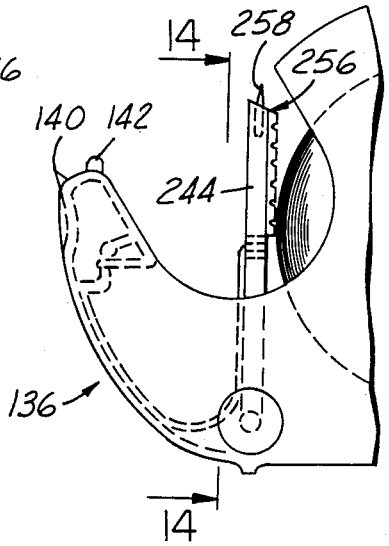
FIG. 15
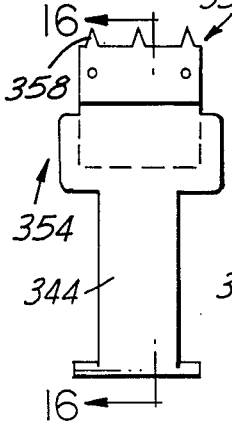
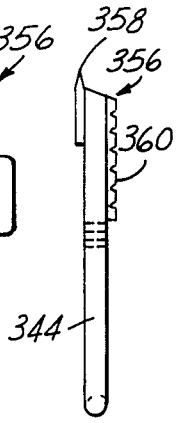
FIG. 16

METHOD AND APPARATUS FOR DISPENSING A TAPE PRODUCT

FIELD OF THE INVENTION

This invention relates to apparatus for dispensing tape products, and more particularly, to an apparatus for dispensing a determinate length of tape product that has a leading end portion with a tab, so that the determinate length may be cut off and applied adheringly to a surface and the tab may be grasped to lift the tape product from the surface after a temporary use of the determinate length of tape product. The invention also relates to apparatus for dispensing tape products of the kind called "adhesive tape" having at least one sticky or adhesive side, so that a determinate length of the tape product has a tab, whereby the determinate length may be applied adheringly to a surface and the tab may be grasped to lift the tape product from the surface after a temporary use.

BACKGROUND OF THE INVENTION

The varied applications for the many types of rolled tapes call for a variety of types of dispensers. One of the simplest types of dispensers heretofore known is commonly used to dispense ordinary transparent tape. The type of dispenser being spoken of supports a roll of tape in a housing carrying a cutting edge downstream in the path in which the roll unwinds. The tape is dispensed by grasping a free end extending from the roll, stripping an extending portion of tape from the roll, pulling a desired length of the extending portion across the cutting edge, and severing the desired length from the extending portion.

In many instances it is highly desirable that the tape be used as a device for what might be considered a permanent attachment of one surface article to another, for example the attachment of a flat, paper cut-out onto the surface of a scrap book page. For such use of the tape, even the most simple dispensers present the tape to the user so that an adhesive side of the tape may be conveniently pressed against the article to be mounted and the surface on which the article is to be mounted. The tape may be smoothed out, in the case of transparent tape until it becomes practically invisible. But when smoothed out for maximum bonding, the tape can only be removed by picking at its edges to gain the leverage to grasp and pull the tape away. By this technique tape is usually destroyed, sometimes the surfaces to which the tape is attached are damaged, and in some instances tape is left on the surfaces.

In many other instances, it is highly desirable that the tape be used as a device for temporary attachment of one surface article to another. For one example, drafting tape is applied to temporarily hold paper in place while it is being drawn or drafted upon. For another, tape of the same or similar constitution is used for masking areas or providing straight edge templates during painting. Either of these two examples calls for a quick and efficient method of removing the tape after its temporary use, including a quick and efficient method of grasping the tape adhering to a surface even if the adherence is of a relatively low order. As yet another example, slips of paper containing annotations are sometimes temporarily attached by transparent tape to "clean" documents in original condition without annotations, so that the documents may be photocopied with the appearence of having the annotations on them.

After the photocopying, the slips containing the annotations are to be detached from the documents to restore them to their "clean", original condition. For this latter use, conventional adhesive dispenser makes no accomodation and fingers must be used to attach tabs or form tabs to be grapsed to pull away the tape after its temporary use. Such operations take up time, involve excessive manual touching of the tape, and are complicated by difficulty in removing tape from the fingers.

PRIOR ART

A number of prior art tape dispensers only remotely address considerations incorporated into the present invention, and then, only by chance.

U.S. Pat. No. 4,204,618 issued to Reed et al. makes reference in column 1, lines 46 et seq., to a "Take-A-Turn" ticket dispenser. Of particular interest is the description, in lines 55–59, of a "bunching up" mechanism at the out feed of the dispenser. Also of interest is the description of a tongue or "tab". The structure of the "Take-A-Turn" ticket dispenser is adapted to bunch by wedging a pre-existing tab, thereby securing the tab for tearing off a leading portion of ticket tape. The present invention is distinguishable, however, on several counts. For one, the structure of the present invention is for dispensing adhesive tape rather than ticket tape. For another, the present invention creates a tab by "bunching", rather than depends on a "tab" for bunching.

U.S. Pat. No. 3,971,280 issued to Inka and U.S. Pat. No. 3,035,345 issued to Barnard both disclose tape dispensers with manually operated advancing means adjacent cutting edges of the respective dispensers. The advancing means of Inka is indicated by numeral 79, and the advancing means of Barnard is indicated by numeral 24. Neither reference teaches advancing tape into contact with itself so as to create a tab, as will be shown to be an advantage taught by the present invention.

U.S. Pat. No. 3,625,100 also issued to Barnard discloses an adhesive tape dispenser with a spring operated device 50 that bends the tape over a cutting edge. In contrast to the present invention, the mechanism of Barnard is dedicated to keeping the tape from bending back upon itself, which teaches away from the manner in which the advantageous tab in accordance with the present invention is created.

U.S. Pat. No. 2,576,404 issued to Krueger discloses an adhesive tape dispenser that is designed to allow an operator to detach a strip of tape in a manner that the operator can conveniently and controllably present the tape for attachment to a surface. The teaching of Krueger does not involve, however, a teaching of creating a tab for convenient detachment of the strip of tape once it has been mounted on the surface.

Finally, U.S. Pat. No. 2,540,697 issued to Staples discloses a tape dispenser with an attachment for separating a tape strip into narrower strips. This reference is of interest because it shows an accomodation that may be added to the simple, conventional dispenser described above.

OBJECTS OF THE INVENTION

Accordingly, it is one object of the present invention to provide an apparatus as an accomodation adaptable to a simple, conventional tape dispenser, the accomodation being designed to dispense a tape that is to be used for temporarily attaching one surface article to another, as well as to dispense tape that is to be adheringly used for permanently attaching one surface article to another.

Another object of the invention is to provide an apparatus for dispensing a tape product that may be used for temporary attachment whereby the tape product is dispensed quickly in a condition allowing it to be grasped without excessive manual touching and without difficulty in removing it from the fingers, and whereby after the temporary attachment, the tape product may be conveniently detached.

Yet another object of the invention is to provide an apparatus for creating a tab on the leading end of a tape produce dispensed from a dispenser whereby the tape product may be manipulated by handling the tab and whereby the tab may be used to grasp the tape product to conveniently detatch the tape product after its attachment and temporary use.

Still yet another object of the present invention to provide an apparatus for advancing a tape product in a dispenser whereby the tape product is advanced into sticky contact with itself so as to create a tab for handling the tape product and for grasping the tape product to conveniently detatch the tape product after its attachment and temporary use.

SUMMARY OF THE INVENTION

These and other object are accomplished in the present invention by an apparatus for dispensing a determinate length of a tape product so that the tape has a leading end portion tab. The invention is particularly adapted for a tape product characterized as having a leading end portion and at least one trailing portion. The tape product may also be characterized as having at least one adhesive side. The apparatus is so structured that the tape product is to be drawn from upstream to downstream along a feeding path that has an upstream end and a downstream end.

The apparatus includes dispenser means described as a housing adapted to receive rotatable feed means, the rotatable feed means being a roll of the tape product disposed adjacent the upstream end. An extension of the housing extends to and is integral with a stationary touch element disposed in the feeding path proximate a cutting edge disposed at the downstream end. The housing thus establishes the feeding path, which is between the roll of the tape product and the cutting edge.

A movable touch element is also disposed in the feeding path, but upstream of the stationary touch element. The movable touch element makes contact with the tape product. There may be adhesion between the tape product and the movable touch element; however, there are embodiments of the invention that include sticking pins on the movable touch element to facilitate its attachment to the tape product. The movable touch element is translatable to and fro generally along the feeding path. In its "to" translation, the movable touch element is translatable toward the stationary touch element and into juxtaposition with it. In its "fro" translation, the movable touch element is translatable away from the stationary touch element to a disposition remote from it. Preferably, the movable touch element is biased into its "fro" translation into a position remote from the stationary touch element.

In a method, also disclosed, the tape product may be drawn so that the leading end portion is in contact with the stationary touch element. The contact may be a sticky contact depending on the adhesive character of the tape product with regard to the stationary touch element. The movable touch element may be translated into contact, which also may be a sticky contact depending on the adhesive character of the tape product, with at least one trailing portion of the tape product and then further translated into juxtaposition with the stationary touch element, bringing a portion of the tape product, a portion proximate the at least one trailing portion, into contact with a portion of the tape product proximate the leading end portion, immediately upstream of the stationary touch element. Accordingly, a tab is formed.

The tab may be grasped to draw the tape product downstream along the feeding path and beyond the cutting edge until the determinate length of tape product is beyond the cutting edge. The determinate length is cut off at the cutting edge and may thereafter be applied adheringly to a surface. The tab may be subsequently grasped to lift the tape product from the surface after its temporary use.

BRIEF DESCRIPTION OF THE DRAWINGS

FIG. 9 is a fragmentary side view in elevation of a second embodiment of an tape product dispenser incorporating the present invention.

FIG. 10 is an end view in elevation of the tape product dispenser shown in FIG. 9.

FIG. 11 is a sectional view along 11—11 of FIG. 9.

FIG. 12 is a sectional view along line 12—12 of FIG. 9.

FIG. 13 is a fragmentary side view in elevation of a third embodiment of a tape product dispenser incorporating the present invention.

FIG. 14 is a sectional view along line 14—14 of FIG. 13.

FIG. 15 is an elevational view of a tab producing lever in accordance with a fourth embodiment of a tape product dispenser incorporating the present invention.

FIG. 16 is a sectional view along line 16—16 of FIG. 15.

DETAILED DESCRIPTION OF THE PREFERRED EMBODIMENT

Figure 2:
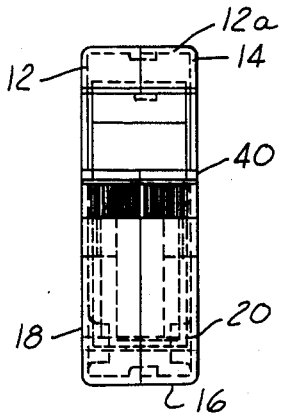
FIG. 2 is an end view in elevation of the tape product dispenser shown in FIG. 1.
Figure 1:
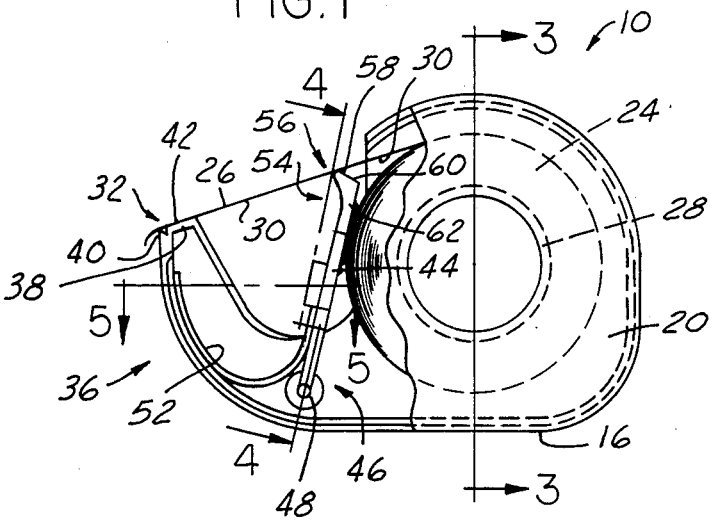
FIG. 1 is a fragmentary side view in elevation of a first embodiment of an tape product dispenser incorporating the present invention.

Referring now to the drawing and in particular to FIGS. 1 and 2, reference numeral 10 generally indicates the tape dispenser housing. Housing 10 can be made of any suitable material including plastic and metal.

Figure 3:
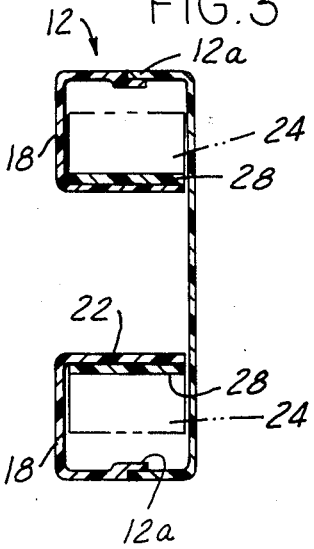
FIG. 3 is a sectional view along line 3—3 of FIG. 1.
Figure 4:
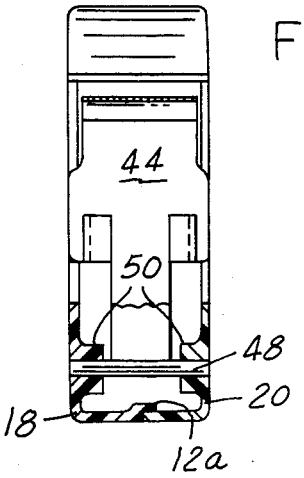
FIG. 4 is a sectional view along line 4—4 of FIG. 1.

In the specific embodiment shown, the housing 10 is sectioned into two parts, one part being insert section 12 and the other part being overfit section 14. The structure shown in FIG. 3, although not a limitation of the invention, has insert section 12 and overfit section 14 held together by a frictional fit of locking flanges 12*a*, which extend from insert section 12 and which are received by overfit section 14 in a manner known by those skilled in the art.

Owing to the shapes of sections 12 and 14, housing 10 has a generally flat base 16. Parallel sides 18 and 20 upstand from the longitudinal edges of base 16. An inwardly directed annular flange of one of the sides, shown particularly in FIG. 3 as side 18, forms a spindle 22 which is adapted to receive a supply roll 24 of the tape product 26.

Roll 24 is formed of a continuous strip of tape product 26 wound around a spool 28. A tape product 26 having an adhesive side 30 is rolled so that the adhesive side 30 faces radially inwardly. Spool 28 sits upon spindle 22 in a manner that it is freely rotational. Accordingly, tape product 26 may be unwound from roll 24 as spool 28 rotates on spindle 22. When tape product 26 unwinds from roll 24, a leading end portion 32 including a leading end 34 of the continuous strip of tape product 26 is fed out from roll 24 in a direction here now defined as downstream of roll 24. Because of the radially inwardly orientation of the adhesive side 30 when wound on roll 24, adhesive side 30 faces toward base 16. When a supply of the tape product making up roll 24 is exhausted by a complete unwinding of roll 24, sections 12 and 14 of housing 10 may be pulled apart so that a new roll may be seated on spindle 22, and sections 12 and 14 may then be joined again.

In accordance with the principles of the present invention shown particularly in FIG. 1, the housing 10 has an extension 36 in the direction that is downstream of the roll 24 and upwardly from base 16. Generally parallel to the base 16 is a ledge 38 atop extension 36 of housing 10. At the downstreammost edge of ledge 38 is a cutting edge 40. Ledge 38 extends from its downstream edge to an upstream edge to provide a stationary touch element 42 for tape product 26.

As the tape product 26 is unwound as a continuous strip from roll 24, with its leading end portion 32, including leading end 34 fed downstream to cutting edge 40, stationary touch element 42 is disposed in the feeding path proximate cutting edge 40. In this position, stationary touch element 42 provides an anchor for the tape product 26 when a portion of the tape product 26 extends beyond the cutting edge 40 so that, when the portion extending beyond the cutting edge 40 reaches a determinate length, and another, upstream portion of tape product 26 is anchored on stationary touch element 42, the determinate length of tape product 26 can be cut off. The tape product 26 remaining in the feed path and extending from the roll 24 is accordingly anchored to the stationary touch element 42 as the adhesive side 30 is in adhering contact therewith.

A lever 44 has an end 46 that is generally disposed at a pivot axis along which a pin 48 extends. In the embodiment shown in the FIGS. 1, 4, 6, and 7, pin 48 may be a separate structure from lever 44, but this is not a limitation of the invention. Lever 44 and pin 48 may be made of the same suitable material as housing 10, including plastic and metal material, or pin 48 and lever 44 may be made of different materials. Pin 48 is pivotably received in anchor extensions 50 of sidewalls 18 and 20 to provide a pivot axis for pin 48 and lever 44, so that lever 44 is rotatable to and fro in the direction of the feed path.

Figure 5:
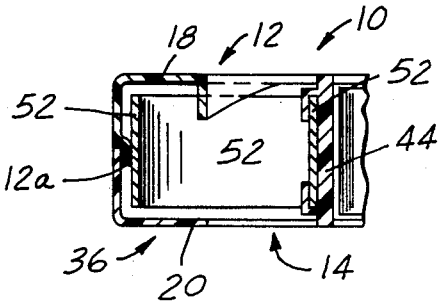
FIG. 5 is a sectional view along line 5—5 of FIG. 1.

As can be seen in FIG. 5, insert section 12 curvingly extends inwardly from wall 18 at extension 36 of housing 10 to provide supporting structure for ledge 38 atop the extension 36 of housing 10, thus providing clearance for lever 44 to rotate. A leaf spring 52, shown in FIGS. 1, 5, 6, and 7, biases lever 44 into a position that is contiguous to, but not necessarily touching roll 24, as shown particularly in FIG. 1. Leaf spring 52 is preferably made of pretempered spring steel and is connected to lever 44 and housing 10 by a conventional seating device, as by being held in place by tabs or flanges, or leaf spring 52 is connected to lever 44 and housing 10 by a small screw.

Lever 44 extends to an opposite end 54 that has a touch part 56 thereat. Touch part 56 includes a touching border 58 and a pusher plate 60 which depends from touching border 58. Pusher plate 60 rests against roll 24 under the biasing influence of leaf spring 52. It should be appreciated that pusher plate 60 may extend down a portion of the backside 62 of lever 44 at end 54.

Preferably, as lever 44 is held into its biased position by leaf spring 52, touch part 56, including touching border 58 and pusher plate 60, contacts the adhesive side 30 of tape product 26 as it spans from roll 24 to stationary touch element 42, but this is not required of the invention. An operator may hold housing 10 with one hand and, with fingers of the other hand, press against on or both edges of lever 44, as for example grasping both edges of lever 44 respectively with the fleshy parts of the thumb and index fingers, and push lever 44 against biasing leaf spring 52 to cause lever 44 to rotate downstream toward stationary touch element 42.

Thus, lever 44 operates as a movable touch element disposed in the feeding path upstream of stationary touch element 42 so as to be translatable along the feeding path toward stationary touch element 42 and into juxtaposition with it and so as to be translatable away from stationary touch element 42 to a disposition remote from it.

Figure 6:
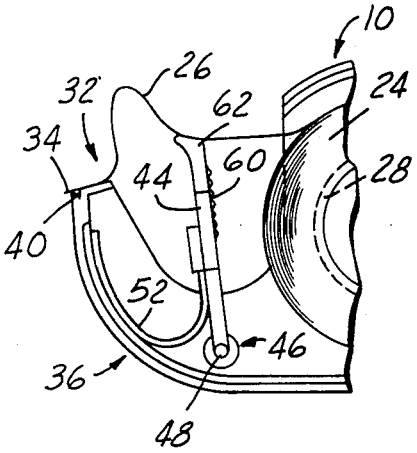
FIG. 6 is the first of two fragmentary side views showing operative moving parts in two progressive positions during operation of the tape product dispenser incorporating the present invention.
Figure 7:
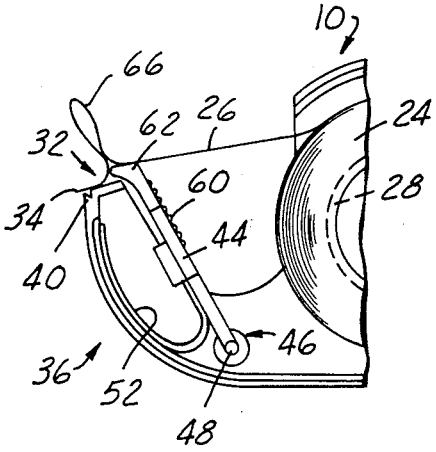
FIG. 7 is the second of two fragmentary side views showing operative moving parts in two progressive positions during operation of the tape product dispenser incorporating the present invention.
Figure 8:
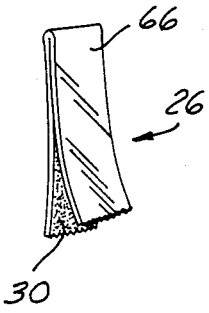
FIG. 8 is a fragmentary view of a tape product tab in accordance with the present invention.

In operation, when touch part 56 is most remote from the stationary touch element 42, that is, when lever 44 is contiguous to roll 24, either no part of lever 44 is in contact with adhesive side 30 of tape product 26 or touching border 58 is in initial contact with adhesive side 30, as is shown in FIG. 1. As lever 44 rotates in the downstream direction, influenced by a finger or fingers of an operator pushing lever 44, touching border 58 comes into initial or greater contact with adhesive side 30 of tape product 26. As lever 44 continues to rotate in the downstream direction, still influenced by a finger or fingers of an operator pushing flange or flanges 64, a loop develops in the tape product 26, as is shown in FIG. 6, when a trailing portion of the adhesive side 30 of the tape product 26—the trailing portion being immediately downstream of the portion contacting touching border 58—is brought by the rotating lever 44 into a closer proximity with a portion of the adhesive side 30 of tape product 26 proximate leading end portion 32 and immediately upstream of the portion of the adhesive side 30 of tape product 26 contacting stationary touch element 42. Finally, as lever 44 reaches the extreme position in the downstream direction shown in FIG. 7, a tab 66 is developed from the loop in the tape product 26, when the trailing portion of the adhesive side 30 of the tape product 26 is brought by the rotating lever 44 into contact with the portion of the adhesive side 30 of tape product 26 proximate leading end portion 32 and immediately upstream of the portion of the adhesive side 30 of tape product 26 contacting stationary touch element 42.

Reference now will be made to FIGS. 9 and 10 to illustrate a second embodiment of the invention. In FIGS. 9 and 10, reference numeral 110 generally indicates the tape dispenser housing, which is also preferably made of plastic or metal or both.

As with the first embodiment, the housing 110 of this second embodiment is sectioned into two parts. One section 112 may be held together with the other section 114 by a keyed frictional fit, as shown in FIG. 11. They may be joined in the manner discussed in connection with the first embodiment.

Housing 110 is shaped with a generally flat base 116 with parallel sides 118 and 120 upstanding from the longitudinal edges of base 116. Spindle 122 is adapted to receive supply roll 24 of the continuous strip of tape product 26 around spool 28.

As used in the first embodiment of the invention, tape product 26 may have an adhesive side 30 rolled so that the adhesive side 30 faces radially inwardly. Spool 28 sits upon spindle 122 in a manner that it is freely rotational, so that tape product 26 may be unwound from roll 24 as spool 28 rotates on spindle 122. When tape product 26 unwinds from roll 24, a leading end portion 32 including a leading end 34 of the continuous strip of tape product 26 is fed out from roll 24 in the downstream direction. Because of the radially inwardly orientation of the adhesive side 30 when wound on roll 24, adhesive side 30 faces toward base 116.

Housing 110 extends as an extension 136, the extension 136 is in the downstream direction and upwardly from base 116. Generally parallel to the base 116 is a ledge 138, which is atop the extension 136 of housing 110 and which has a cutting edge 140 at its downstreammost edge.

A ridge or bread 142 extends across ledge 138 upstream of and generally parallel to cutting edge 140 to provide an advantageous anchoring contact for the adhesive side 30 of tape product. Accordingly, ridge or bead 142 is a stationary touch element 142 for this second embodiment of the invention. Touch element 142 provides additional leverage for pulling down the tape product 26 across cutting edge 140 as tape product 26 spans from roll 24 to stationary touch element 142.

As the tape product 26 is unwound as a continuous strip from roll 24, with its leading end portion 32, including leading end 34 fed downstream to cutting edge 140, stationary touch element 142 is disposed in the feeding path proximate cutting edge 140. In this position, stationary touch element 142 provides an anchor for the tape product 26 when a portion of the tape product 26 extends beyond the cutting edge 140 so that, when that portion reaches a determinate length, it can be cut off. The tape product 26 remaining in the feed path and extending from the roll 24 is accordingly anchored to the stationary touch element 142 as the adhesive side 30 is in adhering contact therewith.

A lever 144 has an end 146 that is generally disposed at a pivot axis along which a pin 148 extends. In the embodiment shown in the FIG. 12, pin 148 is integral with lever 144, and lever 144 and pin 148 are made of the same suitable material as housing 110, including plastic and metal material. Pin 148 is pivotably received in anchor extensions 150 of sidewalls 118 and 120, so that lever 144 is rotatable about the axis of pin 148 to and fro in the direction of the feed path.

As can been seen in FIGS. 12, lever 144 extends to an opposite end 154 that has a touch part 156 thereat. Touch part 156 includes a touching border 158 and a pusher plate 160 which depends from touching border 58. Pusher plate 160 rests against roll 24 under the biasing influence of leaf spring 152. With particular reference to FIGS. 9 and 12, the knurled surface of pusher plate 160 inhibits adherring contact between pusher plate 160 and residue which may have been left on roll 24 by adhesive side 30 of tape product 26 after a portion of tape product 26 had been peeled off of roll 24. Pusher plate 60 extends down a portion of the backside 162 of lever 144 at end 154.

Lever 144 in the second embodiment operates as lever 44 in the first embodiment, that is, as a movable touch element disposed in the feeding path upstream of stationary touch element 142 so as to be translatable along the feeding path toward stationary touch element 142 and into juxtaposition with it and so as to be translatable away from stationary touch element 142 to a disposition remote from it. Accordingly, when lever 144 is contiguous to roll 24 and either no part of lever 144 is in contact with adhesive side 30 of tape product 26 or touching border 158 is in initial contact with adhesive side 30, lever 144 is rotated in the downstream direction, influenced by a finger or fingers of an operator pushing lever 144, so that touching border 158 comes into initial or greater contact with adhesive side 30 of tape product 26. As lever 144 continues to rotate in the downstream direction, still influenced by a finger or fingers of an operator pushing flange or flanges 164, a loop develops in the tape product 26, when a trailing portion of the adhesive side 30 of the tape product 26—the trailing portion being immediately downstream of the portion contacting touching border 158—is brought by the rotating lever 144 into a closer proximity with a portion of the adhesive side 30 of tape product 26 proximate leading end portion 32 and immediately upstream of the portion of the adhesive side 30 of tape product 26 contacting stationary touch element 142. Finally, as lever 144 reaches the extreme position in the downstream direction, a tab 66 is developed from the loop in the tape product 26.

Third and fourth embodiments of the invention differ from the first and second embodiments essentially in the structure of the lever and touching parts. The essential difference in the third embodiment from the other embodiments is shown in FIGS. 13 and 14. Lever 244 extends to an opposite end 254 that has touch parts 256 thereat. Touch parts 256 include a plurality of sticking pins 258 and a pusher plate 260 from which sticking pins 258 extend. Sticking pins 258 are used to tack tape product 26 to draw the portion tacked downstream as lever 244 rotates in the downstream direction of the feed path. It should be appreciated from this teaching that the stationary touch element, which is a part of the housing, may also have sticking pins to tack the tape product 26 thereto.

The fourth embodiment of the invention, seen in FIGS. 15 and 16, is as described in either the first or second embodiment with regard to FIGS. 1–14, except that lever 344 is to be used in lieu of lever 44 or 144. Lever 344 extends to an end 354 that has touch parts 356 thereat. Touch parts 356 include a plurality of sticking pins 358 and a metal pusher plate 360 from which sticking pins 358 extend. Metal pusher plate 360 may be riveted or attached in like manner to lever 344. As with the third embodiment shown in FIGS. 13 and 14, sticking pins 358 are used to tack tape product 26 to draw the portion tacked downstream as lever 344 rotates in the downstream direction of the feed path. Also, as with the third embodiment, it should be appreciated that the stationary touch element, which is a part of the dispenser housing, may also have sticking pins to tack the tape product 26 thereto.

The structure of the apparatus suggests independently of it a novel method for dispensing tape product 26. Reference is made to the drawings depicting the first embodiment, which is particularly appropriate where tape product 26 is a single sticky side 30 adhesive tape, but the method may be employed with any of the apparatus. The method involves a step in which a substantial portion of tape product 26 is extended from an upstream end of the feed path to the downstream end of the feed path. The tape product 26 is extended over a first touch element, in the preferred embodiment, movable touch element 42, which is proximate the upstream end, and a second touch element, stationary touch element 42 when referenced to the preferred embodiment, which is proximate the downstream end so as to be remote from the upstream end.

Another step involves bringing the second touch element 42 into adhering contact, which may be tacking contact, with the tape product 26. The first touch element 42 is also brought into adhering contact with the tape product 26.

Yet another step involves a relative translation of the first and second touch elements 44 and 42 into juxtaposition, to result in the tape product 26 proximate the first touch element 44 being brought into contact, preferrably into adhering contact, with the tape product 26 proximate the second touch element 42.

The steps of the method produce tab 66 which may be grasped to draw the tape product 26 along the feeding path until the tape product 26 is cut off to form a terminal end. Tab 66 may also be grasped to lift the tape product 26 from any surface with which the tape product 26 is thereafter placed.

I claim:

1. Apparatus for dispensing a determinate length of a tape product with a leading end portion tab, the tape product being characterized as having a leading end portion and at least one trailing portion and the tape product being drawn from upstream to downstream along a feeding path having an upstream end and downstream end, the apparatus comprising:

dispensing means for establishing the feeding path;

a roll for holding the tape product mounted within said dispenser;

a fixed cutting edge disposed at the downstream end of the feeding path;

a stationary touch element disposed in the feeding path upstream of and proximate the cutting edge;

said dispenser means having opposed side portions and a bottom portion connecting said side portion extending at least from the roll to the cutting edge to provide lateral and underlying coverage for any members mounted within the dispenser; and a movable touch element disposed within said dispenser in the feeding path upstream of the stationary touch element and being translatable within said dispenser along the feeding path toward the stationary touch element and into juxtaposition therewith and being translatable away from the stationary touch element to a disposition remote therefrom, biasing means disposed within said dispenser biasing the movable touch element away from the stationary touch element;

whereby, when the movable touch element is remote from the stationary touch element and the tape product is drawn so that the leading end portion is in contact with the stationary touch element and the movable touch element is in contact with the at least one trailing portion of the tape product, the movable touch element may be translated within said dispenser into juxtaposition with the stationary touch element so as to bring a portion of the tape product proximate the leading end portion into contact with a portion of the tape product proximate the at least one trailing portion and thereby form a tab, which tab may be grasped to draw the tape product downstream along the feeding path and beyond the cutting edge until the determinate length of tape product is beyond the cutting edge and cut off at the cutting edge.

2. The apparatus of claim 1 further comprising rotatable feed means for receiving said roll of the tape product so that a substantial portion of the tape product may be unwound and extended along the feeding path, the rotatable feed means being juxtaposed to the upstream end of the feed path.

3. The apparatus of claim 2 further wherein the dispenser means is a housing adapted to receive the rotatable feed means, the rotatable feed means being a roll of the tape product, the housing having an extension extending to and integral with the stationary touch element and the cutting edge, the housing thus affording the feeding path between the roll of the tape product and the cutting edge.

4. The apparatus of claim 3 wherein the movable touch element includes a pivot pin having at least one end connected to the housing and a lever having a first end that has a touch part for contact with the tape product and a second end that is attached to the pivot pin so that the lever extends therefrom and is rotatable in one direction so that the touch part is remote from the stationary touch element and in another direction so that the touch part is in juxtaposition to the stationary touch element.

5. The apparatus of claim 1 wherein the movable touch element is a lever having a first end that has a touch part for contact with the tape product and a second end that is generally disposed at a pivot axis, the lever being rotatable in one direction so that the touch part is remote from the stationary touch element and rotatable in another direction so that the touch part is in juxtaposition with the stationary touch element.

6. The apparatus of claim 5 wherein the touch part includes a plurality of sticking pins extending from a pusher plate, so that the contact between the tape product and the touch part is a tacking contact.

7. The apparatus of claim 6 wherein the stationary touch element includes a plurality of sticking pins projecting across the feeding path so that the contact between the tape product and the stationary touch element is a tacking contact.

8. The apparatus of claim 7 wherein the pusher plate has a knurled surface facing the roll, so that the pusher plate does not adhere to a sticky residue left on the roll by an adhesive side of the tape product.

9. The apparatus of claim 6 wherein the touch part includes a touching border and a pusher plate extending from the touching border, whereby when the touch part is remote from the stationary touch element, the touching border is in initial sticky contact with the tape product, and as the lever rotates in said another direction, a loop develops in the tape product which loop becomes a tab when the portion of tape product proximate the leading end portion comes into contact with the portion of the tape product proximate the at least one trailing portion.

10. The apparatus of claim 1 wherein the tape produce is also characterized as having at least one adhesive side so that, when the movable touch element is remote from the stationary touch element and the tape product is drawn so that the leading end portion is in sticky contact with the stationary touch element and the movable touch element is in sticky contact with the at least one trailing portion of the tape product, the movable touch element may be translated into juxtaposition with the stationary touch element so as to bring a portion of the adhesive side of the tape product proximate the leading end portion into contact with a portion of the adhesive side of the tape product proximate the at least one trailing portion and thereby form a tab, which tab may be grasped to draw the tape product downstream along the feeding path and beyond the cutting edge until the determinate length of tape product is beyond the cutting edge, cut off at the cutting edge, and applied adheringly to a surface and which tab may be grasped to lift the tape product from the surface.

11. A method for dispensing a tape product so that the tape product has a leading end portion tab for grasping the tape product, the method comprising the steps of:

extending a substantial portion of the tape product from an upstream end of a feed path in a downstream end of the feed path, the tape product being extended over a pivotable first touch element that is proximate the upstream end and a second touch element that is proximate the downstream end so as to be remote from the upstream end and where a biasing means biases the first touch element away from the second touch element, the first touch element and the biasing means being surrounded on its lateral sides and its bottom by a housing member;

bringing the second touch element into contact with the tape product;

bringing the first touch element into contact with the tape product;

translating the first touch element into juxtaposition with the second touch element so that the tape product proximate the first touch element is brought into contact with the adhesive side of the tape product proximate the second touch element, thereby to form a tab;

grasping the tab to draw the tape product along the feeding path and past a fixed cutting edge until a determinate length of the tape product has been drawn past the cutting edge; and cutting off the tape product to define a determinate length of the tape product extending between the terminal end and a leading end portion having the tab which may be grasped to lift the tape product from any surface.

12. The method of claim 11 wherein the tape product has an adhesive side so that all of said contacts are adhering contacts.

13. The method of claim 11 wherein at least one sharp pin projects from each of the first and second touch elements so that all of said contacts are tacking contacts.

14. Apparatus for dispensing a determinate length of adhesive tape from a roll, the tape being unwindable from the roll and feedable along a feeding path so as to extend from upstream to a downstream end, the tape having a leading end portion downstream of a trailing portion, the trailing portion being downstream of the roll, the apparatus comprising:

a housing adapted to receive the roll of tape, the housing having an extension extending downstream of the roll;

a fixed cutting edge disposed at the downstream end;

a stationary touch element disposed in the feeding path proximate the cutting edge, the extension of the housing extending to and integral with the stationary touch element and the cutting edge, the housing thus affording the feed path between the roll of the tape and the cutting edge, the housing extension being open at the top and having side walls and a bottom portion connecting the side walls; and a movable touch element disposed within said housing between the side walls and in the feeding path upstream of the stationary touch element and being translatable within the housing along the feeding path toward the stationary touch element and into juxtaposition therewith and being translatable away from the stationary touch element to a disposition remote therefrom, biasing means disposed within said housing for biasing said movable touch element away from said stationary touch element;

whereby, when the movable touch element is remote from the stationary touch element and the tape is drawn so that the leading end portion is in sticky contact with the stationary touch element, the movable touch element may be translated into contact with the trailing portion of the tape product and then further translated into juxtaposition with the stationary touch element so as to bring a portion of the adhesive side of the tape product proximate the leading end portion into contact with a portion of the adhesive side of the tape product proximate the trailing portion and thereby form a tab, which tab may be grasped to draw the tape product downstream along the feeding path and beyond the cutting edge until the determinate length of tape product is beyond the cutting edge, cut off at the cutting edge, and applied adheringly to a surface and which tab may be grasped to lift the tape product from the surface.

* * * * *